US007067469B2

(12) United States Patent
Yanagisawa et al.

(10) Patent No.: US 7,067,469 B2
(45) **Date of Patent: *Jun. 27, 2006**

(54) SOLID-SHAPED DETERGENT

(75) Inventors: Yuhki Yanagisawa, Wakayama (JP); Nobuyoshi Yamaguchi, Wakayama (JP); Shu Yamaguchi, Wakayama (JP); Hitoshi Takaya, Wakayama (JP); Hiroyuki Yamashita, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/661,643

(22) Filed: Sep. 15, 2003

(65) Prior Publication Data

US 2004/0127387 A1 Jul. 1, 2004

Related U.S. Application Data

(63) Continuation of application No. 09/594,025, filed on Jun. 15, 2000, now Pat. No. 6,645,931.

(30) Foreign Application Priority Data

Jun. 15, 1999 (JP) ..... 11-168459

(51) Int. Cl.
*C11D 17/00* (2006.01)

(52) U.S. Cl. ..... 510/446; 510/294; 510/298; 510/443; 510/447; 510/452

(58) Field of Classification Search ..... 510/446, 510/294, 298, 447, 443, 452
See application file for complete search history.

(56) References Cited

U.S. PATENT DOCUMENTS

| | | | | |
|---|---|---|---|---|
| 3,383,321 | A | 5/1968 | Davis et al. | 510/298 |
| 3,451,928 | A | 6/1969 | Fischer | 510/298 |
| 3,557,003 | A | 1/1971 | Morris et al. | 510/298 |
| 3,887,614 | A | 6/1975 | Susuki et al. | 510/455 |
| 4,451,386 | A | 5/1984 | Joshi | 510/298 |
| 4,707,290 | A * | 11/1987 | Seiter et al. | 510/443 |
| 5,024,778 | A | 6/1991 | Grecsek | 510/349 |
| 5,139,693 | A * | 8/1992 | Wilms et al. | 510/438 |
| 5,225,100 | A * | 7/1993 | Fry et al. | 510/298 |
| 5,358,655 | A | 10/1994 | Kruse et al. | 510/224 |
| 5,382,377 | A | 1/1995 | Raehse et al. | 510/451 |
| 5,866,531 | A | 2/1999 | Assmann et al. | 510/446 |
| 6,221,832 | B1 | 4/2001 | Casteel et al. | 510/446 |
| 6,284,722 | B1 | 9/2001 | Yamaguchi et al. | 510/357 |
| 6,376,453 | B1 | 4/2002 | Kubota et al. | 510/438 |
| 6,645,931 | B1 * | 11/2003 | Yanagisawa et al. | 510/446 |

FOREIGN PATENT DOCUMENTS

| | | |
|---|---|---|
| CA | 2040307 | 10/1992 |
| DE | 19722832 | 12/1998 |
| EP | 0741637 | 12/1955 |
| EP | 0711828 A2 | 5/1996 |
| EP | 0896052 | 2/1999 |
| GB | 2331994 | 6/1999 |
| JP | 45-23618 | 8/1970 |
| JP | 45-30705 | 10/1970 |
| JP | 50-25603 | 3/1975 |
| JP | 53-13203 | 5/1978 |
| JP | 4-253800 | 9/1992 |
| JP | 5-186800 | 7/1993 |
| JP | 10-195486 | 7/1998 |
| JP | 10183199 A | 7/1998 |
| WO | WO9820096 | 5/1998 |
| WO | WO9824873 A1 | 6/1998 |
| WO | 99-24547 | 5/1999 |

* cited by examiner

*Primary Examiner*—Lorna M. Douyon
(74) *Attorney, Agent, or Firm*—Birch Stewart Kolasch & Birch LLP

(57) ABSTRACT

A solid-shaped detergent comprising particles for detergent, wherein the particles have a dissolution rate of 90% or more, under conditions where the particles are supplied in water at 5° C.; stirred for 60 seconds under the stirring conditions that 1 g of the particles are supplied to a 1-L beaker having an inner diameter of 105 mm which is charged with 1 L of hard water having 71.2 mg $CaCO_3$/L, wherein a molar ratio of Ca/Mg is 7/3, and stirred with a stirring bar of 35 mm in length and 8 mm in diameter at a rotational speed of 800 rpm; and filtered with a standard sieve having a sieve-opening of 74 μm as defined by JIS Z 8801, wherein the dissolution rate of the particles is calculated by the Equation (1):

$$\text{Dissolution Rate (\%)}=[1-(T/S)]\times 100, \quad (1)$$

wherein S is a weight (g) of the particles supplied; and T is a dry weight (g) of insoluble remnants of the particles remaining on the sieve when an aqueous solution prepared under the above stirring conditions is filtered with the sieve.

3 Claims, No Drawings

SOLID-SHAPED DETERGENT

This application is a continuation of application Ser. No. 09/594,025, filed on Jun. 15, 2000, now U.S. Pat. No. 6,645,931 and for which priority is claimed under 35 U.S.C. § 120; and this application claims priority of Application No. 11-168459 filed in Japan on Jun. 15, 1999 under 35 U.S.C. 119.

BACKGROUND OF THE INVENTION

1. Field of the Invention

The present invention relates to a solid-shaped detergent.

2. Discussion of the Related Art

The solid-shaped detergent has merits of not necessitating to measure, easy handling, and being compact, taking up a little storage space. An example thereof is a tablet detergent prepared by compressing or densifying a usual detergent, which has been marketed in Europe and the like.

However, these solid-shaped detergents do not sufficiently satisfy two important features as manufactures, i.e. having sufficient mechanical strength during drying, and rapidly distributing and dissolving when supplied in water. For instance, European Patent Publication 0711828 and Japanese Patent Laid-Open No. Hei 10-183199 each discloses a tablet detergent having improved dissolubility which can be molded at a low compression pressure, the tablet detergent being prepared by compression-molding after coating a detergent particle, or at least a part thereof with a binder, and a manufacturing process thereof.

In addition, WO98/24873 discloses a tablet detergent prepared by forming a shell with a coating agent such as a dicarboxylic acid on a compressed detergent composition. These tablet detergents are effective as a detergent composition having improved disintegration-promoting property and dissolubility, as compared to a composition obtained simply by directly tableting the constituent particle, or the like.

However, the disintegration-promoting property and the dissolubility of the solid-shaped detergent are greatly dependent upon the disintegration-promoting property and the dissolubility of the detergent particle itself constituting the detergent. In addition, even though the most important feature in the washing operation is to release detergent components in the detergent particle into washing water, the properties or structure of the detergent particle itself has not been sufficiently studied. For instance, in none of the marketed solid-shaped detergents mentioned above, the disintegration-promoting property and the dissolubility of the detergent particle itself are not sufficient, so that the disintegration-promoting property and the dissolubility of the solid-shaped detergent itself are consequently unsatisfactory.

An object of the present invention is to provide a fast-dissoluble, solid-shaped detergent having sufficient mechanical strength during drying, and being capable of quickly dissolving in water after supply.

The above and other objects of the present invention will be apparent from the following description.

SUMMARY OF THE INVENTION

In sum, the present invention pertains to:

[1] a solid-shaped detergent comprising particles for detergent, comprising a particle capable of releasing a bubble from an inner portion of the particle in a process of dissolving the particle in water, the bubble having a size of one-tenth or more of a particle size of the particle, and wherein the particles have a dissolution rate of 90% or more, under conditions where the particles are supplied in water at 5° C.; stirred for 60 seconds under the stirring conditions that 1 g of the particles are supplied to a 1-L beaker having an inner diameter of 105 mm which is charged with 1 L of hard water having 71.2 mg $CaCO_3$/L, wherein a molar ratio of Ca/Mg is 7/3, and stirred with a stirring bar of 35 mm in length and 8 mm in diameter at a rotational speed of 800 rpm; and filtered with a standard sieve having a sieve-opening of 74 μm as defined by JIS Z 8801, wherein the dissolution rate of the particles is calculated by the Equation (1):

$$\text{Dissolution Rate (\%)}=[1-(T/S)]\times 100 \quad (1)$$

wherein S is a weight (g) of the particles supplied; and T is a dry weight (g) of insoluble remnants of the particles remaining on the sieve when an aqueous solution prepared under the above stirring conditions is filtered with the sieve; and

[2] a solid-shaped detergent comprising particles for detergent comprising base particles for supporting a surfactant and/or detergent particles prepared by supporting a surfactant to the base particles, wherein each base particle comprises a water-insoluble inorganic compound, a water-soluble polymer and a water-soluble salt, wherein the base particle has a localized structure in which larger amounts of the water-soluble polymer and/or the water-soluble salt are present near the surface of the base particle rather than in the inner portion thereof, and wherein the particles have a dissolution rate of 90% or more, under conditions where the particles are supplied in water at 5° C.; stirred for 60 seconds under the stirring conditions that 1 g of the particles are supplied to a 1-L beaker having an inner diameter of 105 mm which is charged with 1 L of hard water having 71.2 mg $CaCO_3$/L, wherein a molar ratio of Ca/Mg is 7/3, and stirred with a stirring bar of 35 mm in length and 8 mm in diameter at a rotational speed of 800 rpm; and filtered with a standard sieve having a sieve-opening of 74 μm as defined by JIS Z 8801, wherein the dissolution rate of the particles is calculated by the Equation (1):

$$\text{Dissolution Rate (\%)}=[1-(T/S)]\times 100 \quad (1)$$

wherein S is a weight (g) of the particles supplied; and T is a dry weight (g) of insoluble remnants of the particles remaining on the sieve when an aqueous solution prepared under the above stirring conditions is filtered with the sieve.

DETAILED DESCRIPTION OF THE INVENTION

1. Solid-Shaped Detergent 1.1. Definition

In the present invention, the term "solid-shaped detergent" refers to those comprising particles for detergent having fast dissolubility, wherein the particles comprise, for instance, base particles for supporting a surfactant (hereinafter simply referred to as "base particles") and/or fast-dissoluble detergent particles; and separately added components other than the detergent particles (detergent components: a known detergent particle, a builder, a fluorescent dye, an enzyme, a perfume, a defoaming agent, a bleaching agent, a bleaching activator, a binder, a disintegration-promoting agent, and the like), wherein the detergent has a solid form such as tablet, briquette or bar. The term "base particle for supporting a surfactant" (hereinafter simply referred to as "base particle") refers to a base particle comprising a water-insoluble inorganic compound, a water-soluble polymer and a water-soluble salt, wherein the base particle is capable of supporting a surfactant or the like, and the term "base particles" refers to an aggregate thereof. The term "fast-dissoluble detergent particle" refers to a detergent particle comprising a base particle and a surfactant, wherein the surfactant is supported to the base particle, and the term "fast-dissoluble detergent particles" refers to an aggregate thereof. The term "particles" refers to an aggregate of various particles constituting the detergent.

1.2. Composition and Preparation Process

One feature of the solid-shaped detergent of the present invention resides in that the solid-shaped detergent comprises particles for detergent having fast dissolubility. The particles include, for instance, base particles and/or fast-dissoluble detergent particles. As described below, in these particles, since the particle itself has high disintegration-promoting property/dissolubility ascribed to its chemical and physical structure, the solid-shaped molded product comprising the particles also exhibits remarkably high disintegration-promoting property/dissolubility, as compared to a solid-shaped detergent prepared by molding a known detergent particle. In addition, in the present invention, the solid-shaped detergent having excellent disintegration-promoting property/dissolubility can be obtained by not only containing these particles (fast-dissoluble detergent particles and/or base particles), but also simultaneously containing known detergent particles or detergent components together with the particles. For instance, a known compact detergent particle (for instance, "ATTACK" manufactured by Kao Corporation) is uniformly mixed with fast-dissoluble detergent particles, and the mixture is molded, whereby the solid-shaped detergent having improved disintegration-promoting property and excellent dissolubility can be obtained. Here, the amount of the particles formulated is preferably 10% by weight or more, more preferably 25% by weight or more, most preferably 50% by weight or more, of the solid-shaped detergent.

In the present invention, when the starting composition comprising the particles is compressed or densified (hereinafter simply referred to as "compressed") to mold into a solid-shaped form, there can be obtained a detergent composition having excellent dissolubility in which the dissolution property of the particle is exhibited by molding the starting composition at a low compression pressure so as not to disintegrate the particle structure of the particles. In addition, it is preferable to further treat the detergent particle obtained by low compression pressure molding by a process comprising coating the particle with a binder, and molding the resulting particle; a process comprising forming a shell using, for instance, a coating agent, or the like on the particle, and the like, from the viewpoints of high (mechanical) strength and excellent handleability.

In addition, it is preferable that the solid-shaped detergent has a macro-air gap (hollowness), in order that after the solid-shaped detergent is supplied in water, water sufficiently enters into the inner portion of the solid-shaped detergent, whereby the dissolubility is increased. The use of a binder serves to prepare the solid-shaped detergent at low compression pressure and to secure a macro-air gap. It is preferable that the binder is a solid or powder at ordinary temperature (20° C. or so) and is water-soluble, and has a melting point of from 40° to 100° C. The binder includes, for instance, water-soluble polymers such as polyethylene glycols, polyvinyl pyrrolidones, water-soluble polyacrylates, and polyvinyl alcohols. Especially, the polyethylene glycols can be suitably used. As the polyethylene glycol, especially preferable are those having weight-average molecular weights of from 1300 to 20000, as calculated from hydroxyl value as determined by pyridine-phthalic anhydride method in accordance with JIS K 1557 6.4; and those having a melting point of 40° to 100° C., as determined by a method in accordance with JIS K 8001. The amount of the binder formulated is preferably from 0.1 to 10% by weight, more preferably from 1 to 5% by weight, of the solid-shaped detergent. These binders may be previously heat-melted or dissolved in water, and thereafter coated on the particle. In addition, when the binder is solid, the binder is pulverized into a powder form; thereafter the binder and the starting composition mentioned above (or at least a part thereof) are supplied into a mixer; and the mixture is heated with tumbling to melt the binder, thereby depositing the binder on the surface of these particles. A process for preparing a tablet detergent comprising a binder includes a process disclosed in Japanese Patent Laid-Open No. Hei 10-183198.

In addition, preferable processes are a process comprising compression-molding a starting composition, and thereafter forming a shell thereon with a coating agent disclosed on Example 1, page 19 of WO98/24873; and a process disclosed on pages 15 to 22 of WO94/25563, comprising heat-treating a granular solid aggregate comprising a hydrate with a microwave.

When a disintegration-promoting agent is added, the binder quickly dissolves or undergoes disintegration when the binder contacts water, whereby the solid-shaped detergent mentioned above accomplishes a further excellent dissolution property. Preferable disintegration-promoting agents are physical disintegration-promoting agents which act on swelling. Examples of these disintegration-promoting agents include starches, starch derivatives such as carboxymethyl starch, cellulose, cellulose derivatives such as carboxymethyl cellulose, fine crystalline cellulose, saccharides (especially, sorbitol), and layered silicates (especially, bentonite or fine swellable layered silicate particles of smetite-type). In addition, there can be also formulated water-soluble salts having an effect for improving the dissolubility, including, for instance, acetates, succinates, citrates, and the like, especially sodium acetate, sodium citrate, and the like. Also, organic salts such as sodium tripolyphosphates can be used. As a bubbling disintegration-promoting agent, a weak acid such as citric acid or tartaric acid can be used in combination with an alkali metal carbonate or an alkali metal bicarbonate.

The solid-shaped detergent can be further formulated with enzyme-containing granules, softening component-containing granules such as quaternary ammonium salts, foam-controlling component-containing granules such as dimethylsilicone, perfume-containing granules, bleaching agents such as sodium percarbonate and sodium perforate, and the like.

The apparatus used for the preparation of the solid-shaped detergent having the composition described above is not particularly limited, and there can be used, for instance, a tableting machine such as a briquetting machine. The tableting machine includes a single-shot tableting machine or a rotary tableting machine.

1.3. Size and Strength

The shape of the solid-shaped detergent includes a shape described in accordance with JIS K 8841, among which a cylindrical form, a cubic form, and the like are preferable. The molding pressure, such as tableting pressure, is preferably 1 kgf/cm$^2$ or more, from the viewpoint of imparting preferable mechanical strength, and the molding pressure is preferably 50 kgf/cm$^2$ or less, more preferably 30 kgf/cm$^2$ or less, from the viewpoints of preventing crushing of the particle and securing a given macro-air gap ratio (hollowness ratio). In addition, the disintegration-hardness is preferably 2 kgf or more, more preferably 3 kgf or more. Here, the disintegration-hardness is a disintegration-hardness taken in the diameter direction of the solid-shaped detergent in accordance with JIS Z 8841.

1.4. Disintegration-Promoting Property

The disintegration-promoting property of the solid-shaped detergent can be evaluated by its disintegration-promoting ratio, and the disintegration-promoting ratio is preferably 25% or more, more preferably 50% or more. Here, the disintegration-promoting ratio can be obtained as follows.

Specifically, 15 g of a solid-shaped detergent is allowed to stand on a sieve having a pore with a diameter of 1 cm, and the solid-shaped detergent together with the sieve are gently soaked into 1 L of hard water (71.2 mg $CaCO_3$/L, Ca/Mg (molar ratio)=7/3) in a beaker. After passage of 1 minute, the solid-shaped detergent is taken out of the beaker together with the sieve, and the insoluble remnants on the sieve are dried for 2 hours in an electric dryer heated to 105° C., and thereafter the dried insoluble remnants are cooled by maintaining in a desiccator (25° C.) with a silica gel for 30 minutes. After cooling, the weights of the dried insoluble remnants for the detergent, the sieve, and the collected vessel are determined, and the disintegration-promoting ratio for the solid-shaped detergent is obtained by the following equation:

$$\text{Disintegration-Promoting Ratio (\%)}=\{1-(T/W)\}\times 100$$

wherein T is a dry weight (g) of the insoluble remnants obtained under the above conditions; and W is an initial weight (g) of the solid-shaped detergent.

1.5. Dissolubility

The dissolubility of the solid-shaped detergent can be evaluated by its dissolution rate, and the dissolution rate, as a standard for not arising such problems as insoluble remnants of the detergent, is preferably 70% or more, more preferably 80% or more. Here, the dissolution rate can be obtained as follows.

Specifically, 15 g of a solid-shaped detergent is supplied into a twin-tub type washing machine (commercially available from Toshiba Corporation under the trade name: "GINGA Model 3.6 VH-360 SI") to which 30 L of tap water at 20° C. is previously supplied. The electric conductivity is determined as follows, with stirring at a stirring strength set at a "standard" mode for 20 minutes.

The electric conductivity is determined by using a conductivity meter commercially available from To a Denpa Kogyo under the trade name: TOA ConductivityMeter CM-60Swo. The saturation value for the electric conductivity is defined as a conductivity when the rate of change in the determined value with respect to the previous determined value is less than 1% when the electric conductivity is determined every 30 seconds after initiation of stirring. Here, the determination of the electric conductivity is made for at least 5 minutes. The dissolution rate is determined under the following equation disclosed on page 24 of Japanese Patent Laid-Open No. Hei 10-88199.

$$\text{Dissolution Rate (\%)} = \frac{\text{Electric Conductivity of Washing Water at Given Time Period} - \text{Electric Conductivity of Water Before Supplying Detergent}}{\text{Saturated Electric Conductivity of Washing Water} - \text{Electric Conductivity of Water Before Supplying Detergent}} \times 100$$

The dissolubility is evaluated as dissolution rate after 3 minutes from initiation of stirring.

In the solid-shaped detergent of the present invention having the constitution described above, since its detergent components can be quickly eluted into a washtub, while retaining its merits such as handleability owned by the solid-shaped detergent, there are exhibited an effect of improving the detergency and a great effect in quality such as no occurrence of insoluble remnants.

2. Detergent Particle and Base Particle 2.1. Mechanism of Fast Dissolubility 2.1.1 Fast Dissolubility by Releasing Bubble The particles used in the present invention each comprises a particle capable of releasing a bubble of one-tenth or more of the particle size of the particle in a process in which the detergent particle is dissolved in water (hereinafter referred to as "bubble-releasing particle"), and in a process in which the bubble-releasing particle is dissolved in water, the bubble-releasing particle firstly releases a bubble having a given size from the inner portion of the particle by allowing a small amount of water to enter into the inner portion thereof, and subsequently the particle itself undergoes disintegration (self-disintegration of the particle) by allowing a large amount of water to enter into the inner portion of the particle, so that not only the dissolution from a portion near the surface takes place but also the dissolution and disintegration from the inner portion of the particle take place.

The dissolution behavior described above can be confirmed by a digital microscope or optical microscope as a phenomenon in which a bubble of one-tenth or more, preferably one-fifth or more, more preferably one-fourth or more, still more preferably one-third or more, of the particle size of the particle (hereinafter referred to as "bubble having a given size") is released in a case where the bubble-releasing particle is dissolved in water. In addition, even after molding into a solid detergent, the dissolution behavior can be confirmed by carefully separating the detergent into individual bubble-releasing particles and observing the particles in the same manner as above. It is preferable that in a case where the bubble-releasing particle is dissolved in water with a stand-still state, the bubble having a given size is generated within 120 seconds, more preferably within 60 seconds, still more preferably within 45 seconds.

The bubble-releasing particle may be, for instance, a uni-core detergent particle which is explained in the subsequent Section 2.4, or it may be a detergent particle other than the uni-core detergent particle, including, for example, a detergent particle in which the uni-core base particle is aggregated (hereinafter referred to as "multi-core detergent particle" as described in Section 2.6.). It is more preferable that the bubble-releasing particle has uni-core property, from the viewpoint of dramatically enhancing the dissolution speed. In addition, it is preferable that the bubble-releasing particle constitutes 60% by weight or more, more preferably 80% by weight or more, of the particles.

The size of the bubble released from the inner portion of the particle is measured as follows.

A double-sided adhesive tape is attached to a bottom center of a glass petri dish (inner diameter: 50 mm). The particles are adhered to the double-sided adhesive tape. First, an equivalent diameter (a μm) for each of the particles is calculated from an image obtained by a digital microscope (for example, one commercially available from KEYENCE CORPORATION, "VH-6300").

Subsequently, 5 mL of ion-exchanged water at 20° C. was poured into the glass petri dish, and the dissolution behavior for the individual particles of the subject measurement is observed. When the bubble is released from the inner portion of the particle, the equivalent diameter (β μm) of the bubble is measured from an image of an instant at which the bubble leaves from the particle. Incidentally, in a case where a plurality of bubbles are released from the inner portion of the particle, "β μm" is referred to a maximum value of the equivalent diameter measured for each of the bubbles. The ratio of the bubble diameter to the particle size (β/α) for each of the particles is calculated. In a bubble-releasing particle, it is preferable that a macro-air gap, concretely, a pore having a size of one-tenth to four-fifth, preferably one-fifth to four-fifth, the particle size is present in the inner portion of the particle.

The size of the pore (pore size) can be measured as follows.

The selected particle is split at a cross section so as to include the maximum particle size without crashing the particle with a surgical knife, or the like. The split cross section is observed by a scanning electron microscope (SEM). In a case where the equivalent diameter (particle size) [γ μm] of a split cross section of the split particle and the presence of a pore in the inner portion of the particle are confirmed, an equivalent diameter of the pore (pore size) [δ μm] is measured. Incidentally, in a case where a plurality of pores are confirmed, the equivalent diameter [δ μm] is defined as the largest pore size among them. Thereafter, the ratio of the pore size to the particle size (δ/γ) is calculated.

In addition, in a case where the bubble-releasing particle is constituted by the base particle described below, it is preferable that the base particle has a structure of having a pore in the inner portion of the base particle, the pore having a size of one-tenth to four-fifth, preferably one-fifth to four-fifth, the particle size of the base particle.

2.1.2 Fast Dissolubility by Localized Structure of Base Particle

In the particles used in the present invention, apart from the dissolution mechanism mentioned above, or in combination with the dissolution mechanism, the fast dissolubility from the particle surface can be observed. The features thereof reside in that the particles comprise base particles and/or detergent particles prepared by supporting a surfactant to the base particles, wherein each base particle comprises a water-insoluble inorganic compound (A), a water-soluble polymer (B) and a water-soluble salt (C), wherein the base particle has a localized structure such that a larger amount of the water-soluble polymer and/or the water-soluble salt is present near the surface of the base particle rather than in the inner portion thereof (hereinafter simply referred to as "localized structure of the base particle"). The base particle in which a larger amount of the water-soluble substances is localized near the surface can exhibit fast dissolubility because the water-soluble components near the surface are more quickly dissolved in water, thereby showing a dissolution behavior in which the disintegration of the particle from the particle surface is accelerated.

2.2. Composition of Base Particle

The water-insoluble inorganic compound (A) is preferably those having a primary average particle size of from 0.1 to 20 μm. Examples thereof include crystalline or amorphous aluminosilicates, silicon dioxide, hydrated silicate compounds, clay compounds such as perlite and bentonite, and the like, among which crystalline or amorphous aluminosilicates, silicon dioxide and hydrated silicate compounds are favorably used. In particular, the crystalline aluminosilicates are preferable.

The water-soluble polymer (B) includes carboxylic acid-based polymers, carboxymethyl cellulose, water-soluble starches, sugars, and the like, among which the carboxylic acid-based polymers are preferable. Especially, the salts of acrylic acid-maleic acid copolymers and the salts of polyacrylic acids (Na, K, $NH_4$, and the like) are particularly excellent. The molecular weight is preferably from 1000 to 80000.

Besides the above carboxylic acid-based polymers, there can be used polymers such as polyglyoxylates; cellulose derivatives such as carboxymethyl cellulose; aminocarboxylic acid-based polymers such as polyaspartates.

The water-soluble salt (C) includes water-soluble inorganic salts such as carbonates, hydrogencarbonates, sulfates, sulfites, hydrogensulfates, phosphates and halides; and water-soluble organic acid salts having low-molecular weights such as citrates and fumarates. Among them, carbonates, sulfates, and sulfites are preferable. The inorganic salts are preferable because the pore in the particle is further thermally expanded by causing hydration heat and dissolution heat by the reaction with water after preparation of the base particles, thereby accelerating the self-disintegration of the particle.

Here, sodium carbonate is preferable as an alkalizing agent showing a suitable pH buffer region in the washing water. The alkalizing agents other than sodium carbonate include amorphous or crystalline silicates.

The composition of the base particle is as follows. The content of the water-insoluble inorganic compound (A) is preferably from 20 to 90% by weight, more preferably from 30 to 75% by weight, most preferably from 40 to 70% by weight. The content of the water-soluble polymer (B) is preferably from 2 to 30% by weight, more preferably from 3 to 20% by weight, most preferably from 5 to 20% by weight. The content of the water-soluble salt (C) is preferably from 5 to 78% by weight, more preferably from 10 to 70% by weight, still more preferably from 10 to 67% by weight, particularly preferably from 20 to 60% by weight, most preferably from 20 to 55% by weight. Within the above ranges, the base particle is favorable in the aspects of having a structure in which near the surface of the base particle is coated with a water-soluble component, so that the coating layer is sufficiently formed on the particle surface, thereby making its particle strength sufficient. Also, it is preferable from the viewpoint of the dissolubility of the resulting detergent composition.

In addition, besides these three components (A) to (C), the base particle may also include surfactants and other auxiliary components suitably used in detergent compositions, such as fluorescent dyes, pigments and dyes.

In order to obtain the desired particle strength and bulk density, although the surfactant is substantially not required as an essential component of the base particle, the surfactant may be added in a slurry prepared in Step (I) of Section 2.5.1. described below in order to improve the drying efficiency in Step (II). The amount of the surfactant in the slurry is preferably 10% by weight or less, more preferably from 1 to 10% by weight, most preferably from 2 to 8% by weight. Incidentally, these amounts are obtained on the basis of the solid components of the slurry.

In order to exhibit excellent fast dissolubility even when a large amount of a surfactant is added, the higher the supporting ability of the surfactant to the base particle the better. Examples of a method for improving the supporting ability of the base particle include use of base materials having a large supporting ability (oil-absorbing ability) as the water-insoluble inorganic compound (A). Examples of suitable base material include A-type zeolite (for example, trade name: "TOYOBUILDER," commercially available from Tosoh Corporation; oil-absorbing ability measured by a method according to JIS K 5101 of from 40 to 50 mL/100 g); P-type zeolite (for example, trade names: "Doucil A24" and "ZSE064" commercially available from Crosfield B.V.; oil-absorbing ability: 60 to 150 mL/100 g); and X-type zeolite (for example, trade name: "Wessalith XD" commercially available from Degussa-AG; oil-absorbing ability: 80 to 100 mL/100 g). In addition, amorphous silica and amorphous aluminosilicates can be used. For example, favorable are those having properties described on Japanese Patent Laid-Open No. Hei 5-5100, column 4, line 34 to column 6, line 16 (especially, the oil-absorbing carriers described on column 4, line 43 to 49); and Japanese Patent Laid-Open No. 6-179899, column 12, line 12 to column 13, line 17 and column 17, line 34 to column 19, line 17.

2.3. Localized Structure of Base Particle

As a method for confirming the localized structure of the base particle, there can be employed, for instance, a combined method of Fourier transform infrared spectroscopy (FT-IR) and photoacoustic spectroscopy (PAS) (simply abbreviated as "FT-IR/PAS"). As described in "*APPLIED SPECTROSCOPY,*" 47, 1311–1316 (1993), the distribution state of the substances in the direction of depth from the surface of the samples can be confirmed by the method.

The measurement method for determining the structure of the base particle used in the present invention will be exemplified below.

Each cell is charged with each base particle of two different states to conduct FT-IR/PAS measurement, and the structure of the base particle can be determined by comparing the measurement values. In other words, one FT-IR/PAS measurement is taken for the base particle in a state where the desired structure is retained, and another FT-IR/PAS measurement is taken for the comparative sample in which the base particle is in a uniform state by sufficiently grinding the base particle with an agate mortar. The FT-IR/PAS is measured, for instance, by using an infrared spectrometer "FTS-60A/896" (manufactured by Bio-Rad Laboratories), and the PAS cell includes a photoacoustic detector "Model 300" manufactured by MTEC Corporation. The measurement conditions are resolution of 8 $cm^{-1}$, scanning speed of 0.63 cm/s, and 128 scans. In the above measurement conditions, the information up to a depth of about 10 μm from the surface of the base particle is included. In the PAS spectra of the base particle, each of the characteristic peaks of sodium carbonate, sodium sulfate, zeolite and sodium polyacrylate can be read off at 1434 $cm^{-1}$ ($CO_3^{2-}$ degenerate stretching vibration), 1149 $cm^{-1}$ ($SO_4^{2-}$ degenerate stretching vibration), 1009 $cm^{-1}$ (Si—O—Si anti-symmetric stretching vibration), and 1576 $cm^{-1}$ ($CO_2$ anti-symmetric stretching vibration), respectively, and the areal intensity of each peak is measured. The relative areal intensity of each of the characteristic peaks of the water-soluble salt such as sodium carbonate or sodium sulfate to the characteristic peaks of the zeolite, when measured for each of the state in which the structure of the base particle is retained, and the state in which the base particle is uniformly ground, is obtained. The resulting relative intensity is then compared with the relative areal intensity of the characteristic peaks of the water-soluble polymer to the characteristic peaks of the zeolite, when measured for each of the above states, and thereby the structural features of the base particle can be determined. Concretely, it can be proven that the base particle has a localized structure such that a larger amount of the water-soluble polymer and/or the water-soluble salts is included near the surface of the base particle than the inner portion thereof, and that a larger amount of the water-insoluble inorganic compound is included in the inner portion of the base particle than near the surface thereof.

With respect to the base particle, ratios of the relative areal intensity of the characteristic peaks of the water-soluble salt and the water-soluble polymer to the characteristic peaks of the zeolite when measured in the state in which the localized structure of the components is retained to the relative areal intensity of the characteristic peaks of the zeolite when measured in the state in which the base particle is ground to give a uniform state are calculated. As to the water-soluble salt, the ratio is 1.1 or more, preferably 1.3 or more, and as to the water-soluble polymer, the ratio is 1.3 or more, preferably 1.5 or more. The base particle can be said to have a localized structure when the base particle has these ratios of relative areal intensities, namely when the contents of the water-soluble salts such as sodium carbonate and sodium sulfate and the water-soluble polymer such as sodium polyacrylate are relatively larger in a portion near the surface thereof, and the content of the water-insoluble inorganic compound such as zeolite is relatively larger in the inner portion of the base particle, As other examples of the method of confirming the localized structure of the base particle, there can be employed energy dispersion-type X-ray spectroscopy (EDS) and electron probe microanalysis (EPMA). By these analysis methods, two-dimensional distribution of elements can be analyzed by scanning the sample surface with an electron beam.

2.4. Properties

It is preferable that the detergent particles used in the present invention comprise a uni-core detergent particle, from the viewpoint of the fast dissolubility. The term "uni-core detergent particle" refers to a detergent particle being prepared by supporting a surfactant to the base particle, wherein a single detergent particle has one base particle as a core.

As a factor for expressing the uni-core property, the degree of particle growth as defined in the equation:

$$\text{Degree of Particle Growth} = \frac{\text{Average Particle Size of Final Detergent Particles}}{\text{Average Particle Size of Base Particles}}$$

can be employed. The degree of particle growth is preferably 1.5 or less, more preferably 1.3 or less.

The term "average particle size of final detergent particles" refers to either an average particle size of the detergent particles obtained after supporting a surfactant to base particles, or an average particle size of the detergent particles in which the resulting detergent particles are subjected to surface improvement treatment.

The uni-core property can be confirmed by at least one method selected from Method (a), Method (b), and Method (c) mentioned below.

Method (a): A method comprising splitting some of the detergent particle arbitrarily sampled from the detergent particles of a size near its average particle size, and observing presence or absence of the base particle and a number of the base particle in the detergent particle by a scanning electron microscope (SEM).

Method (b): A method comprising extracting an organic solvent-soluble component in the detergent particle with an organic solvent in which the water-soluble polymer in the base particle in the detergent particle does not dissolve [for instance, in a case where a polyacrylate is present as a water-soluble polymer, and an anionic surfactant (LAS) or a nonionic surfactant is present as a surfactant in the base particle, ethanol can be favorably used.]; and thereafter observing by SEM observation an organic solvent-insoluble component.

Method (c): A method of confirming the uni-core property comprising detecting a two-dimensional elementary distribution of the split cross section of the detergent particle embedded by the resin by means of EDS or EPMA.

In the present invention, the surfactant to be supported by the base particle includes anionic surfactants, nonionic surfactants, amphoteric surfactants, cationic surfactants, and the like, with a preference given to the anionic surfactants and the nonionic surfactants.

The anionic surfactant includes salts of esters obtained from an alcohol having 10 to 18 carbon atoms and sulfuric acid; salts of esters obtained from an alkoxylated product of an alcohol having 8 to 20 carbon atoms and sulfuric acid; alkylbenzenesulfonates; paraffinsulfonates; α-olefinsulfonates; salts of α-sulfonated fatty acids; esters thereof or salts of fatty acids thereof, and the like. Especially, the linear alkylbenzenesulfonates of which an alkyl moiety has 10 to 14 carbon atoms, more preferably 12 to 14 carbon atoms, are desirable.

The nonionic surfactant includes polyoxyalkylene alkyl (8 to 20 carbon atoms) ethers, alkyl polyglycosides, polyoxyalkylene alkyl(8 to 20 carbon atoms)phenyl ethers, polyoxyalkylene sorbitan fatty acid (8 to 22 carbon atoms) esters, polyoxyalkylene glycol fatty acid (8 to 22 carbon atoms) esters, polyoxyethylene polyoxypropylene block polymers, polyoxyalkylene alkylol (8 to 22 carbon atoms)amides, and the like.

Especially, the polyoxyalkylene alkyl ether prepared by adding an alkylene oxide such as ethylene oxide or propylene oxide to an alcohol having 10 to 18 carbon atoms in an amount of 4 to 20 moles is preferable as the nonionic surfactant, wherein the resulting polyoxyalkylene alkyl ether has an HLB value as calculated by Griffin method of from 10.5 to 15.0, preferably from 11.0 to 14.5.

The amount of the surfactant is preferably from 5 to 80 parts by weight, more preferably from 5 to 60 parts by weight, still more preferably from 10 to 60 parts by weight, particularly preferably from 20 to 60 parts by weight, based on 100 parts by weight of the base particles, from the viewpoint of exhibiting detergency. Here, the supporting amount of the anionic surfactant is preferably from 1 to 60 parts by weight, more preferably from 1 to 50 parts by weight, still more preferably from 3 to 40 parts by weight. The supporting amount of the nonionic surfactant is preferably from 1 to 45 parts by weight, more preferably from 1 to 35 parts by weight, and particularly preferably from 4 to 25 parts by weight. In addition, the amphoteric surfactant or the cationic surfactant may be also used together therewith according to its purpose. The term "supporting amount of the surfactant" used herein does not include the amount of the surfactant added when a surfactant is added in the preparation of slurry in Step (I) of Section 2.5.1 described below.

2.4.1 Fast Dissolubility

In the present invention, the fast dissolubility of the detergent particles or base particles can be evaluated by 60-seconds dissolution rate, wherein a dissolution rate of the detergent particles or the base particles as calculated by the following method is 90% or more. The dissolution rate is preferably 94% or more, more preferably 97% or more.

The test stirring conditions described above are more concretely detailed below. A 1-L beaker (a cylindrical form having an inner diameter of 105 mm and a height of 150 mm, for instance, a 1-L glass beaker manufactured by Iwaki Glass Co., Ltd.) is charged with 1 L of hard water cooled to 5° C. and having a water hardness corresponding to 71.2 mg $CaCO_3$/L (a molar ratio of Ca/Mg: 7/3). With keeping the water temperature constant at 5° C. with a water bath, water is stirred with a stirring bar [35 mm in length and 8 mm in diameter, for instance, commercially available from ADVANTEC, Model "TEFLON SA" (MARUGATA-HOSOGATA)] at a rotational speed (800 rpm), such that a depth of swirling to the water depth is about ⅓. The particles which are accurately sample-reduced and weighed so as to be 1.0000±0.0010 g are supplied and dispersed in water with stirring, and stirring is continued. After 60 seconds from supplying the particles, a liquid dispersion of the particles in the beaker is filtered with a standard sieve (100 mm in diameter) and a sieve-opening of 74 μm as defined by JIS Z 8801 of a known weight. Thereafter, water-containing particles remaining on the sieve are collected in an open vessel of a known weight together with the sieve. Incidentally, the operation time from the start of filtration to collection with the sieve is set at 10 sec±2 sec. The insoluble remnants of the collected particles are dried for one hour in an electric dryer heated to 105° C. Thereafter, the dried insolubles are cooled by keeping in a desiccator with a silica gel at 25° C. for 30 minutes. After cooling the insoluble remnants, a total weight of the dried insoluble remnants of the detergent, the sieve and the collected vessel is measured, and the dissolution rate (%) of the particles is calculated by Equation (1).

$$\text{Dissolution Rate (\%)} = \{1-(T/S)\}\times 100 \quad (1)$$

wherein S is a weight (g) of the particles supplied; and T is a dry weight (g) of insoluble remnants of the particles remaining on the sieve when an aqueous solution prepared under the above stirring conditions is filtered with the sieve.

Even in the above evaluation method using a low-temperature water wherein the dissolution speed of the detergent is lowered, the particles have the high dissolution rate as mentioned above.

2.4.2 Properties of Base Particles

The favorable properties for the base particles used in the present invention are as follows.

2.4.2.1 Bulk density: Ranging from 400 to 1000 g/L, preferably from 500 to 800 g/L. The bulk density is measured by a method according to JIS K 3362.

2.4.2.2 Average particle size: Ranging preferably from 150 to 500 μm, more preferably from 180 to 300 μm. The average particle size is measured by vibrating each of standard sieves (sieve openings: 2000 to 125 μm) according to JIS Z 8801 for 5 minutes, and calculating a median size from a weight percentage depending upon the size openings of the sieves.

2.4.2.3 Particle strength: Ranging preferably from 50 to 2000 kgf/cm$^2$, more preferably from 100 to 1500 kgf/cm$^2$, particularly preferably from 150 to 1000 kgf/cm$^2$. In the above range, the base particles show excellent disintegration-promoting property, so that the detergent particles having excellent fast dissolubility can be obtained. The particle strength is measured by the following method.

A cylindrical vessel of an inner diameter of 3 cm and a height of 8 cm is charged with 20 g of a sample, and the sample-containing vessel is tapped for 30 times with a tapping device (commercially available from Tsutsui Rikagaku Kikai K.K., "Model TVP1" tapping-type close-packed bulk density measurement device; tapping conditions: 36 times/minute, free flow from a height of 60 mm). The sample height (an initial sample height) after tapping is measured. Thereafter, an entire upper surface of the sample kept in the vessel is pressed at a rate of 10 mm/min with a pressing machine to take measurements for a load-displacement curve. The slope of the linear portion at a displacement rate of 5% or less is multiplied by an initial sample height, and the resulting product is divided by a pressed area, to give a quotient which is defined as particle strength.

2.4.2.4 Supporting ability: Preferably 20 mL/100 g or more, more preferably 40 mL/100 g or more. In the above range, the aggregation of the base particle with each other can be suppressed, so that the uni-core property of the particle constituting the detergent particles can be favorably maintained. The supporting ability is measured by the following method.

A cylindrical mixing vessel of an inner diameter of about 5 cm and a height of about 15 cm which is equipped with agitation impellers in the inner portion thereof is charged with 100 g of a sample. With stirring the contents at 350 rpm, linseed oil is supplied at a rate of about 10 mL/min at 25° C. The supporting ability is defined as an amount of linseed oil supplied when the agitation torque reaches the highest level.

2.4.2.5 Water content: Preferably 20% by weight or less, more preferably 10% by weight or less, particularly preferably 5% by weight or less. In this range, the base particles having excellent properties can be obtained. The water content is measured by the following method.

A three-gram sample is placed on a weighing dish, and the sample is dried with an electric dryer at 105° C. for 2 hours. The sample after drying is weighed. The water content is calculated from the weight loss, namely the difference of the weight before and after drying, expressed in percentage.

2.4.3. Properties of the Detergent Particles

The favorable properties for the detergent particles obtained in the present invention are as follows.

2.4.3.1 Bulk density: 500 g/L or more, preferably from 500 to 1000 g/L, more preferably from 600 to 1000 g/L, still more preferably from 650 to 850 g/L. The bulk density is measured by a method according to JIS K 3362.

2.4.3.2 Average particle size: Ranging preferably from 150 to 500 μm, more preferably from 180 to 300 μm. The average particle size is measured in the same manner as the case of the base particles.

2.4.3.3 Flowability: evaluated as flow time of preferably 10 seconds or shorter, more preferably 8 seconds or shorter. The flow time is a time period required for dropping 100 mL of powder from a hopper used in a measurement of bulk density as defined in JIS K 3362.

2.5. Process

The base particles and the detergent particles used in the present invention can be prepared by a process comprising the following steps (I) to (III):

(I): preparing a slurry comprising a water-insoluble inorganic compound, a water-soluble polymer, and a water-soluble salt, wherein 60% by weight or more of water-soluble components comprising the water-soluble polymer and the water-soluble salt are dissolved in the slurry;

(II): spray-drying the slurry obtained in Step (I) to prepare base particles; and (III): adding a surfactant to the base particles obtained in Step (II), thereby supporting the surfactant to the base particles.

Moreover, in order to further improve the properties and quality of the resulting detergent particles, it is preferable to further add a surface-modifying step subsequent to Step (III). Preferred embodiments for each step will be described below.

2.5.1 Step (I) (Step for Preparation of Slurry)

The slurry used in the present invention may be preferably a slurry having a non-setting property which can be conveyed with a pump. Also, the addition method of the components and their order can be appropriately varied depending upon the preparation conditions. It is preferable that the content of the water-insoluble component (A) in the slurry is from 6 to 63% by weight, and the content of each of the water-soluble components (B, C) in the slurry is from 2.1 to 56% by weight.

In order that each of the base particles obtained in Step (II) has the localized structure of the components as described above, the water-soluble components (B, C) in Step (II) are needed to be migrated to the particle surface along with evaporation of moisture. In such case, the dissolution rates of the water-soluble components (B, C) in the slurry become important factors. In other words, it is necessary to prepare a slurry in which the water-soluble components (B, C) are dissolved in an amount of 60% by weight or more, preferably 70% by weight or more, more preferably 85% by weight or more, still more preferably 90% by weight or more. In general, the water content necessary for preparing such a slurry is preferably from 30 to 70% by weight, more preferably from 35 to 60% by weight, most preferably from 40 to 55% by weight. When the water content is low, the water-soluble components (B, C) cannot be sufficiently dissolved in the slurry, and thereby the proportions of the water-soluble components (B, C) which are present near the surface of the resulting base particle are decreased. In addition, when the water content is too high, the water content needed to be evaporated in Step (II) becomes high, thereby lowering its productivity.

The measurement method of the dissolution rate of the water-soluble components (water-soluble polymer and water-soluble salts) in the slurry is as follows. The slurry is filtered under reduced pressure, and the water concentration (P %) in the filtrate is measured. The water content of the slurry is denoted as (Q %), and the concentration of the water-soluble components in the slurry is denoted as (R %). The dissolution rate of the water-soluble components is calculated by Equation (2):

$$\text{Dissolution Rate}\,(\%) = \frac{Q(100-P)}{P} \times \frac{1}{R} \times 100$$

Here, when the calculated dissolution rate exceeds 100%, the dissolution rate is considered to be 100%.

A method for forming a slurry includes, for instance, a process comprising adding an entire amount or almost the entire amount of water to a mixing vessel at first, and in order or simultaneously adding the remaining components, preferably after a stage where a water temperature almost reaches an operable temperature. The usual order of addition comprises firstly adding liquid components such as a surfactant and a polyacrylate, and subsequently adding a water-soluble, powdery starting material such as soda ash. In addition, a small amount of the auxiliary components such as a dye is added. Finally, the water-insoluble component such as zeolite is added. At this time, for the purpose of improving blending efficiency, the water-insoluble component may be added in two or more separate portions. Also, the powdery starting materials may be previously blended, and the blended powder starting materials may then be added to an aqueous medium. Further, after the addition of the entire components, water may be added to adjust its viscosity or the water content of the slurry. After the addition of the entire components in the slurry, the components are blended for preferably 10 minutes or more, more preferably 30 minutes or more, to prepare a uniform slurry.

Also, the temperature of the slurry is preferably from 30° to 80° C., more preferably from 40° to 70° C. When the temperature of the slurry is in the above range, it is preferable from the aspects of the dissolubility of the water-soluble components (B, C) and the liquid conveyability thereof with a pump.

2.5.2 Step (II) (Step for Preparation of Base Particles)

As the drying method of the slurry, in order to allow the base particle to have pores capable of releasing a bubble of a desired size and also allow the base particle to have the localized structure of the components, it is preferable that the slurry is instantaneously dried, and particularly preferably is spray-dried to have the resulting particle shape which is substantially spherical. The spray-drying tower is more preferably a countercurrent tower, from the viewpoints of the improvements in the thermal efficiency and the particle strength of the base particles. The atomization device for the slurry is particularly preferably, for instance, a pressure spray nozzle.

The temperature of the high-temperature gas supplied to the drying tower is preferably from 150° to 300° C., more preferably from 170° to 250° C. In addition, it is preferable that the temperature of the gas exhausted from the drying tower is usually from 70° to 125° C., more preferably from 80° to 115° C.

2.5.3 Step (III) (Step of Supporting Surfactant)

The process of supporting a surfactant to base particles, for instance, when the present invention is carried out in a batch process, includes supplying base particles and a surfactant to a mixer. Examples of such a process include (1) a process comprising supplying base particles in the mixer in advance; and then adding a surfactant thereto; (2) a process comprising simultaneously supplying each of base particles and a surfactant in the mixer in small amounts at a time; and (3) a process comprising supplying a part of base particles in the mixer in advance; and supplying the remaining base particles and a surfactant thereto in small amounts at a time. Among these processes, item (1) above is particularly preferable.

In this step, it is preferable that the surfactant is added in a liquid state, and it is more preferable that the surfactant in a liquid state is supplied by spraying.

Mixers which can be used as devices preferably used for Step (III) include those devices less likely to have strong shearing force against the base particle (i.e. those mixers less likely to cause disintegration of the base particle), wherein the devices have good mixing efficiency, from the viewpoint of the dispersion efficiency of the surfactants. Here, a particular preference is given to a mixer containing an agitating shaft arranged along the center line of a horizontal, cylindrical blending vessel and agitating impellers arranged on the agitating shaft, to carry out blending of the powders (horizontal mixers), including, for instance, Lödige Mixer (manufactured by Matsuzaka Giken Co., Ltd.), PLOUGH SHARE Mixer (manufactured by PACIFIC MACHINERY & ENGINEERING Co., LTD.), and the like.

In addition, in this Step, when a nonionic surfactant is used, a melting point-elevating agent of the nonionic surfactant, which is a water-soluble nonionic organic compound (hereinafter referred to as "melting point-elevating agent") having a melting point of from 45° to 100° C. and a molecular weight of from 1000 to 30000. By adding the melting point-elevating agent, the caking properties and the exudation property of the surfactants in the detergent particles can be suppressed. Examples of the melting point-elevating agent include polyethylene glycols, polypropylene glycols, polyoxyethylene alkyl ethers, pluronic nonionic surfactants, and the like.

The amount of the melting point-elevating agent used is preferably from 0.5 to 5 parts by weight, more preferably from 0.5 to 3 parts by weight, based on 100 parts by weight of the base particles, from the viewpoints of maintaining the uni-core property, and having fast dissolubility, and suppressing the exudation property and the caking properties.

In addition, in a case where an aqueous solution of a surfactant or an aqueous solution of a water-soluble, nonionic organic compound is added, a step of drying excess water contents may be provided.

Further, a powdery builder for detergents can be added. By adding the powdery builder, the particle size of the detergent particles can be controlled, whereby the detergency can be improved. Incidentally, the term "powdery builder" mentioned herein refers to an agent for enhancing detergency other than surfactants which is in a powdery form. Examples thereof include base materials showing metal ion capturing ability, such as zeolite and citrates; base materials showing alkalizing ability, such as sodium carbonate and potassium carbonate; base materials showing both metal ion capturing agent and alkalizing ability, such as crystalline silicates; and other base materials enhancing ionic strength, such as sodium sulfate.

Concretely, crystalline silicates disclosed in Japanese Patent Laid-Open No. Hei 5-279013, column 3, line 17 to column 6, line 24 (in particular, those prepared by a process comprising calcinating and crystallizing at a temperature of 500° to 1000° C. are preferable); Japanese Patent Laid-Open No. Hei 7-89712, column 2, line 45 to column 9, line 34; and Japanese Patent Laid-Open No. Sho 60-227895, page 2, lower right column, line 18 to page 4, upper right column, line 3 (particularly the silicates in Table 2 are preferable) can be used as powdery builders. Here, it is desired that the alkali metal silicates have an $SiO_2/M_2O$ ratio, wherein M is an alkali metal, of from 0.5 to 3.2, preferably from 1.5 to 2.6.

The amount of the powdery builder used is preferably from 0.5 to 12 parts by weight, more preferably from 1 to 6 parts by weight, based on 100 parts by weight of the base particles, from the viewpoints of maintaining the uni-core property of the detergent particle, obtaining excellent fast dissolubility, and favorably controlling the particle size.

2.5.4 Surface-Modifying Step

In the present invention, in order to modify the particle surface of the detergent particles, especially to improve the flowability of the detergent particles, there may be carried out a surface-modifying step comprising adding (1) a fine powder, and (2) liquid materials.

(1) Fine Powder

It is preferable that the average particle size of the primary particle is 10 μm or less, more preferably from 0.1 to 10 μm, from the viewpoints of the improvements in the coating ratio of the particle surface of the detergent particles, so that the flowability and the anti-caking property of the detergent particles are improved. The average particle size of the fine powder can be measured by a method utilizing light scattering by, for instance, a particle analyzer (manufactured by Horiba, LTD.), or it may be measured by a microscopic observation. In addition, it is preferable that the fine powder has a high ion exchange capacity or a high alkalizing ability from the aspect of detergency.

The fine powder is desirably aluminosilicates, which may be crystalline or amorphous. Besides the aluminosilicates, there can be employed sodium sulfate, calcium silicate, silicon dioxide, bentonite, talc, clay, amorphous silica derivatives, silicate compounds such as crystalline silicate compounds, a metal soap, and a powdery surfactant (for instance, alkylsulfates) of which primary particles have a size of 0.1 to 10 μm. The amount of the fine powder used is preferably from 0.5 to 40 parts by weight, more preferably from 1 to 30 parts by weight, particularly preferably from 2 to 20 parts by weight, based on 100 parts by weight of the detergent particles.

(2) Liquid Materials (2-1) Water-Soluble Polymer

Examples of the water-soluble polymer include carboxymethyl cellulose, polyethylene glycols, and polycarboxylates such as sodium polyacrylates and copolymers of acryl acid and maleic acid and salts thereof. The amount of the water-soluble polymer used is preferably from 0.5 to 10 parts by weight, more preferably from 1 to 8 parts by weight, particularly preferably from 2 to 6 parts by weight, based on 100 parts by weight of the detergent particles, from the viewpoints of maintaining the uni-core property of the detergent particle, and having excellent fast dissolubility, flowability and anti-caking properties of the detergent particles.

(2-2) Fatty Acid

Examples of the fatty acid include fatty acids having 10 to 22 carbon atoms. The amount of the fatty acid used is preferably from 0.5 to 5 parts by weight, especially preferably from 0.5 to 3 parts by weight, based on 100 parts by weight of the detergent particles. In a case of a fatty acid in a solid state at ordinary temperature, it is preferable that the fatty acid is heated to a temperature showing flowability, and then supplied to the detergent particles by spraying.

2.6. Other Detergent Particles

The detergent particles used in the present invention can be constituted by a multi-core detergent particle. The multi-core detergent particle may be those in which the above base particle constituting the uni-core detergent particle described in Section 2.4. above is aggregated, or those in which water-soluble salts such as sodium carbonate, and the like used as a core are aggregated. In particular, those in which the base particle constituting the uni-core detergent particle is aggregated are preferable, from the viewpoint of its contribution to the localized structure of the base particle, so that the fast dissolubility can be further improved. Therefore, as the base particle used herein, the base particle in the uni-core detergent particle described above can be used, and as the surfactant which can be supported by the base particle, the surfactant in the uni-core detergent particle described above can be used. In addition, the multi-core detergent particle can be easily formed by increasing the amount of the surfactant. Incidentally, the dissolution acceleration between the base particles can be enhanced by using a foaming agent such as sodium bicarbonate or a percarbonate.

2.6.1. Properties

The detergent particles described above used in the present invention have fast dissolubility. The term "fast dissolubility" as defined in the present invention can be confirmed by the method of Section 2.4.1 described above. In addition, the detergent particles used in the present invention show similarly high dissolution rate to the detergent particles comprising the uni-core detergent particle, thereby showing a higher fast dissolubility than the dissolubility of conventional detergents.

As to the bulk density, the average particle size, and the flowability, it is preferable that the detergent particles have similar properties to those comprising the uni-core detergent particle described in Section 2.4.3 above.

EXAMPLES

Preparation Example 1

Preparation of Base Particles

Four-hundred and ninety kilograms of water was added to a 1 $m^{3-}$ mixing vessel having agitation impellers. After the water temperature reached 55° C., 83 kg of sodium sulfate and 135 kg of a 40% by weight-aqueous sodium polyacrylate (average molecular weight: 10000) solution were added thereto. After stirring the mixture for 15 minutes, 120 kg of sodium carbonate ("DENSE ASH", manufactured by Central Glass Co., Ltd), 9 kg of sodium sulfite, and 3 kg of a fluorescent dye ("Tinopal CBS-X", manufactured by Ciba Geigy AG) were added. After stirring the resulting mixture for additional 15 minutes, 300 kg of zeolite [zeolite 4A, average particle size: 3.5 μm (manufactured by Tosoh Corporation)] was added thereto, and the obtained mixture was stirred for 30 minutes to give a uniform slurry. The final temperature of this slurry was 59° C. In addition, the water content in this slurry was 50% by weight. This slurry was sprayed with a pressure spray nozzle arranged near the top of a spray-drying tower at a spraying pressure of 25 kg/cm$^2$. A high-temperature gas fed to the spray-drying tower was supplied from the lower portion of the tower at a temperature of 225° C. and exhausted from the top of the tower at 105° C. The resulting Base Particles 1 had a bulk density of 620 g/L, an average particle size of 225 μm, a particle strength of 250 kgf/cm$^2$, a supporting ability of 52 mL/100g and a water content of 5% by weight. Incidentally, with regard to Base Particles 1, it was confirmed that pores having a pore size of from 1/10to 4/5the particle size were found in 88% of the particles (Here, an average value for pore size/particle size in 90% of the particles was 2.9/5.)

Preparation Example 2

Preparation of Detergent Particles 1

Fifteen parts by weight of a polyoxyethylene alkyl ether ("EMULGEN 108KM": manufactured by Kao Corporation), 15 parts by weight of sodium dodecylbenzenesulfonate ("NEOPELEX F65": manufactured by Kao Corporation), and 1 part by weight of a polyethylene glycol (average molecular weight: 8500) were mixed with heating to a temperature of 70° C., to prepare a liquid mixture. Next, 100 parts by weight of the above Base Particles were supplied in Lödige Mixer (manufactured by Matsuzaka Giken Co., Ltd.; capacity: 20 L; equipped with a jacket), and agitation was initiated with the mixer having a main shaft (150 rpm) and a chopper (4000 rpm). Incidentally, hot water at 60° C. was allowed to flow through the jacket. The above liquid mixture was supplied into the mixer over a period of 2 minutes, and thereafter the components were agitated for 4 minutes and discharged. Further, the particle surface of the detergent particles was surface-coated with 20 parts by weight of the same zeolite as in Preparation Example 1. The resulting Detergent Particles 1 had an average particle size of 240 μm, a bulk density of 660 g/L and a 60-seconds dissolution rate of 97%. In addition, the detergent particle was found to be a uni-core particle by SEM observation of its cross section.

In addition, the hollowness of Detergent Particles 1 was measured. As a result, it was found that pores having a pore size of from 1/10 to 4/5 the particle size were found in 86% of the particles.

Further, the dissolution behavior of Detergent Particles 1 was observed by a digital microscope. As a result, it was confirmed that bubbles having a size of 1/10 or more of the particle size were released from 87% of the particles. Incidentally, an average value for size of released bubbles/particle size in 87% of the particles was 3.0/5.

Preparation Example 3

Preparation of Detergent Particles 2

There was prepared a slurry having a water content of 50% by weight, comprising components of each ingredient listed in Table 1 except for 50% by weight of the formulated amount of the same polyoxyethylene alkyl ether as in Preparation Example 2, 50% by weight of the formulated amount of zeolite, and the entire formulated amounts of a crystalline silicate and an enzyme, and the slurry was spray-dried to give a powder having a bulk density of 0.26 to 0.3 g/cm$^3$. Subsequently, the powder was supplied into High-Speed Mixer (manufactured by Fukae Powtec Corp.), and 20% by weight of the formulated amount of the zeolite, the remaining polyoxyethylene alkyl ether and the entire formulated amount of the crystalline silicate were added thereto, the mixture was aggregated. Further, 20% by weight of the formulated amount of zeolite was added thereto, and the mixture was aggregated. Thereafter, the resulting particle was dry-blended with the remaining zeolite and the entire formulated amount of the enzyme, to give Detergent Particles 2.

The resulting Detergent Particles 2 had an average particle size of 420 μm, a bulk density of 720 g/L and a 60-seconds dissolution rate of 68%. As a result of SEM observation, the detergent particle was not a uni-core particle.

TABLE 1

| Detergent Particles 2 | |
|---|---|
| Composition (% by weight) | |
| LAS-Na | 23.0 |
| AS-Na | 5.0 |
| Soap | 6.0 |
| Polyoxyethylene Alkyl Ether | 6.0 |
| Crystalline Silicate B (Average Particle Size: 50 μm) | 2.0 |
| Amorphous Silicate | 10.0 |
| Zeolite | 22.0 |
| Sodium Polyacrylate (Mw = 20000) | 5.0 |
| Sodium Carbonate | 10.0 |
| Potassium Carbonate | 3.0 |
| Sodium Sulfate | 1.5 |
| Polyethylene Glycol | 1.0 |
| Enzyme | 2.0 |
| Fluorescent Dye | 0.5 |
| Water | 6.0 |

Note:

LAS-Na (sodium dodecylbenzenesulfonate, the same as that in Preparation Example 2)

AS-Na (sodium $C_{12}$–$C_{14}$ alkyl sulfate, manufactured by Kao Corporation)

Soap (beef tallow fatty acid, manufactured by Kao Corporation)

Crystalline Silicate B (SKS-6, manufactured by Clariant)

Amorphous Silicate (No.2 sodium silicate, manufactured by Central Glass Co., Ltd.)

Sodium Polyacrylate (AQUALIC, manufactured by Nippon Shokubai Co., Ltd.)

Enzyme (Savinase 18T, manufactured by NOVO Industry)

Zeolite, sodium carbonate and the fluorescent dye are the same as those in Preparation Example 1. The polyethylene glycol is the same as that in Preparation Example 2.

Examples 1 to 9, and Comparative Example 1

Preparation of Tablet (Solid-Shaped) Detergent

Tablet detergents of Examples 1 to 9, and Comparative Example 1 were prepared using the particles listed in Table 2 as starting materials in the manner described below. Detergent Particles 1 and 2 and/or Base Particles listed in Table 2 were each introduced into a 10 L-High-Speed Mixer (manufactured by Fukae Powtec Corp.), and the components were tumbled at 150 rpm for the main shaft and at 600 rpm for the chopper, with allowing hot water at 70° C. to flow through a jacket, until the temperature of the particles exceeded 60° C. Thereafter, the above polyethylene glycol was supplied as a binder in an amount of 5.0 parts by weight, based on 100 parts by weight of the particles, and the resulting mixture was tumbled for 2 minutes in such conditions. Subsequently, this mixture and 5.0 parts by weight of the zeolite 4A (average particle size: 3 μm), based on 100 parts by weight of the particles, were introduced into the High-Speed Mixer, and tumbled for 30 seconds, to give particles before molding. Next, the particles were compression-molded at a pressure shown in Table 2, with temperature-controlling to 60° C., and thereafter allowed to cool in the air for 15 minutes, to give a tablet detergent having a diameter of 30 mm and a thickness of 11 mm.

The disintegration ratio and the dissolution rate for each of the tablet detergents obtained in Examples 1 to 9 and Comparative Example 1 are shown in Table 4. Here, the disintegration-hardness, the disintegration ratio and the dissolution rate shown in the table were determined as described in Sections 1.3, 1.4 and 1.5, respectively.

TABLE 2

| | Examples | | | | | | | | | Comp. |
|---|---|---|---|---|---|---|---|---|---|---|
| | 1 | 2 | 3 | 4 | 5 | 6 | 7 | 8 | 9 | Ex. 1 |
| Particles (Parts by Weight) | | | | | | | | | | |
| Detergent Particles 1 | 100 | 100 | 100 | 75 | 50 | 25 | | | | |
| Detergent Particles 2 | | | | | 50 | 75 | 25 | 50 | 75 | 100 |
| Base Particles | | | | | | | 75 | 50 | 25 | |
| Properties | | | | | | | | | | |
| Tabletting Pressure [kgf/cm$^2$] | 5 | 10 | 15 | 10 | 10 | 10 | 10 | 10 | 10 | 10 |
| Disintegration-Hardness [kgf] | 2.9 | 4.1 | 5.7 | 4.2 | 4.5 | 4.7 | 3.3 | 3.9 | 4.1 | 5.3 |
| Disintegration Ratio [%] | 64 | 42 | 37 | 37 | 36 | 25 | 69 | 60 | 42 | 0 |
| Dissolution Rate [%] | 87 | 75 | 71 | 72 | 72 | 70 | 81 | 76 | 70 | 7 |

It is found that all of the tablet detergents obtained in Examples 1 to 9 have a sufficient mechanical strength, and that they are excellent in the disintegration-promoting property/dissolubility, as compared to those of Comparative Example 1.

Since the solid-shaped detergent is excellent in the fast dissolubility having sufficient mechanical strength upon drying and being capable of quickly dissolving in water after supplying thereinto, the deterging components can be quickly eluted into a washtub while maintaining the merits of handleability of the solid-shaped detergent. Therefore, there can be accomplished an effect of improving detergency and a great effect on a product quality of no generation of the remaining insolubles.

What is claimed is:

1. A solid-shaped detergent comprising particles for detergent, comprising a particle capable of releasing a bubble from an inner portion of the particle in a process of dissolving the particle in water, the bubble having a size of one-tenth or more of a particle size of the particle, and wherein the particles have a dissolution rate of 90% or more, under conditions where the particles are supplied in water at 5° C.; stirred for 60 seconds under the stirring conditions that 1 g of the particles are supplied to a 1-L beaker having an inner diameter of 105 mm which is charged with 1 L of hard water having 71.2 mg $CaCO_3$/L, wherein a molar ratio of Ca/Mg is 7/3, and stirred with a stirring bar of 35 mm in length and 8 mm in diameter at a rotational speed of 800 rpm; and filtered with a standard sieve having a sieve-opening of 74 μm as defined by JIS Z 8801, wherein the dissolution rate of the particles is calculated by the Equation (1):

$$\text{Dissolution Rate (\%)} = [1 - (T/S)] \times 100 \quad (1)$$

wherein S is a weight (g) of the particles supplied; and T is a dry weight (g) of insoluble remnants of the particles remaining on the sieve when an aqueous solution prepared under the above stirring conditions is filtered with the sieve;

wherein the particles have a bulk density of 500 g/L or more; and wherein the particles comprise base particles for supporting a surfactant and/or detergent particles prepared by supporting a surfactant to the base particles, wherein said base particle has a localized structure in which larger amounts of the water-soluble polymer and the water-soluble salt are present near the surface of the base particle rather than in the inner portion thereof, wherein each base particle comprises 20 to 90% by weight of a water-insoluble inorganic compound, 2 to 30% by weight of a water-soluble polymer and 10 to 78% by weight of a water-soluble salt, wherein said base particle is obtained by the steps comprising carrying out spray-drying of a slurry, and wherein said base particle has a water content of 5% by weight or less.

2. The solid-shaped detergent according to claim 1, wherein the amount of the surfactant in the slurry is 5% by weight or less.

3. A solid-shaped detergent comprising particles for detergent comprising base particles for supporting a surfactant and/or detergent particles prepared by supporting a surfactant to the base particles, wherein each base particle comprises 20 to 90% by weight of a water-insoluble inorganic compound, 2 to 30% by weight of a water-soluble polymer and 10 to 78% by weight of a water-soluble salt, wherein said base particle has a localized structure in which larger amounts of the water-soluble polymer and the water-soluble salt are present near the surface of the base particle rather than in the inner portion thereof, and wherein the particles have a dissolution rate of 90% or more, under conditions where the particles are supplied in water at 50C, stirred for 60 seconds under the stirring conditions that 1 g of the particles are supplied to a 1-L beaker having an inner diameter of 105 mm which is charged with 1 L of hard water having 71.2 mg $CaCO_3$/L, wherein a molar ratio of Ca/Mg is 7/3, and stirred with a stirring bar of 35 mm in length and 8 mm in diameter at a rotational speed of 800 rpm; and filtered with a standard sieve having a sieve-opening of 74 μm as defined by JIS Z 8801, wherein the dissolution rate of the particles is calculated by the Equation (1):

$$\text{Dissolution Rate (\%)} = [1\ (T/S)] \times 100 \quad (1)$$

wherein S is a weight (g) of the particles supplied; and T is a dry weight (g) of insoluble remnants of the particles remaining on the sieve when an aqueous solution prepared under the above stirring conditions is filtered with the sieve; wherein said base particle is obtained by the steps comprising carrying out spray-drying of a slurry, and wherein said base particle has a water content of 10% by weight or less.

* * * * *